US005746126A

United States Patent [19]

Huang

[11] Patent Number: 5,746,126

[45] Date of Patent: May 5, 1998

[54] RUBBISH COMPRESSING APPARATUS

[76] Inventor: Chai-Yee Huang, No. 47-1 Fanpolin Road, Shipan Chuen, San-Chi Shiang, Taipei Hsien, Taiwan

[21] Appl. No.: 611,261

[22] Filed: Mar. 5, 1996

[51] Int. Cl.[6] ..... B30B 9/06

[52] U.S. Cl. ..... 100/125; 100/226; 100/229 R; 100/249; 100/289

[58] Field of Search ..... 100/125, 226, 100/229 R, 238, 245–249, 289

[56] References Cited

U.S. PATENT DOCUMENTS

| | | | |
|---|---|---|---|
| 137,349 | 4/1873 | Dickinson | 100/249 |
| 757,706 | 4/1904 | Wilson | 100/125 |
| 2,018,126 | 10/1935 | Garrett | 100/249 |

FOREIGN PATENT DOCUMENTS

| | | | |
|---|---|---|---|
| 2254828 | 5/1974 | Germany | 100/226 |
| 2326725 | 12/1974 | Germany | 100/226 |
| 3516170 | 11/1986 | Germany | 100/226 |

*Primary Examiner*—Stephen F. Gerrity
*Attorney, Agent, or Firm*—Pro-Techtor International

[57] ABSTRACT

This invention relates to a rubbish compression apparatus, comprising: a base plate; a main body, mounted on the base plate, into which the rubbish will be thrown; a roughly funnel-shaped compress tube, taking in the rubbish that has been thrown in; a compressing device, having a first pressing plate, which uses a threaded shaft; a shaft, which passes glidingly through the first pressing plate and the threaded shaft along their longitudinal axis; a second pressing plate, mounted below the first pressing plate on the low end of the shaft; and an anvil plate, mounted below an opening in the lower part of the compression tube. The second pressing plate is taken by the shaft to enter the compression tube and pre-compresses the rubbish. After that, the first pressing plate is driven down by use of the threaded shaft, pushing the second pressing plate to further compress the rubbish.

6 Claims, 6 Drawing Sheets

FIG 2-A

RUBBISH COMPRESSING APPARATUS

TECHNICAL FIELD

This invention relates to a rubbish compressing apparatus, especially to a rubbish compressing apparatus suitable for use in households as well as in offices.

BACKGROUND OF THE INVENTION

Today's population concentration in cities leads to the problem of waste generation. Every year vast sums of money and resources are used up for the disposal of a large quantity of waste. Therefore, modern, comparatively advanced cities have adopted measures to increase the comfort and to save on the cost of waste disposal, e.g., the sorting of rubbish. When discarding rubbish, people have to sort it and collect it separately. Afterwards, different sorts of rubbish are disposed of differently. Thereby a fast and economical way of waste disposal is achieved, the impact of waste disposal on the environment is reduced, and useful resources may be obtained back.

Yet modern people produce waste in big volumes consuming a lot of space, like bottles and packing materials. The big volume of waste leads to a bad problem of how to dispose of it. The best way to solve this problem is to compress generated rubbish to a small volume and then to dispose of it.

However, former rubbish compressing apparatuses were mostly designed for rubbish on a large scale. Their volume is large, and their installation is expensive, therefore they cannot be used in households or offices. Their use in common waste disposal sites is not common. So the volume of waste stays high, transport is difficult, and waste that has not been compressed is easily scattered everywhere, contributing to the pollution of the environment.

On most waste disposal sites the waste is buried uncompressed or burnt. Thereby not only the cost of waste disposal rises, but also the load on the disposal installations increases, shortening their lifetime. At the same time there is a disadvantageous effect on the recycling of waste.

The main objective of this invention consists in providing a rubbish compressing apparatus of simple structure and low cost.

A further objective of this invention consists in providing a rubbish compressing apparatus, which can be operated manually and contributes to physical fitness.

A further objective of this invention consists in providing a rubbish compressing apparatus, which is easy to use and suitable for personal use.

A further objective of this invention consists in providing a rubbish compressing apparatus, which is suitable for use in households and in offices.

The technical methods, structural parts and their function in order to achieve these and other objectives will become clear from the following embodiments and suitable related drawings.

BRIEF DESCRIPTION OF THE DRAWINGS

FIG. 2 is a sectional view to explain the operation inside this invention's rubbish compressing apparatus, when rubbish is thrown in.

FIG. 2-A is an enlarged partial view to explain the localization of this invention's drawing shaft and second compressing plate.

BEST MODE TO CARRY OUT THE INVENTION

The essential objective of this invention is to provide for a simple-structured and easy-to-use rubbish compressing apparatus for usage in households and in offices to allow every person in a household or in an office to compress the rubbish prior to further treatment. At the same time this invention's rubbish compressing apparatus is operated manually and thus contributes to physical fitness.

Figure 1:
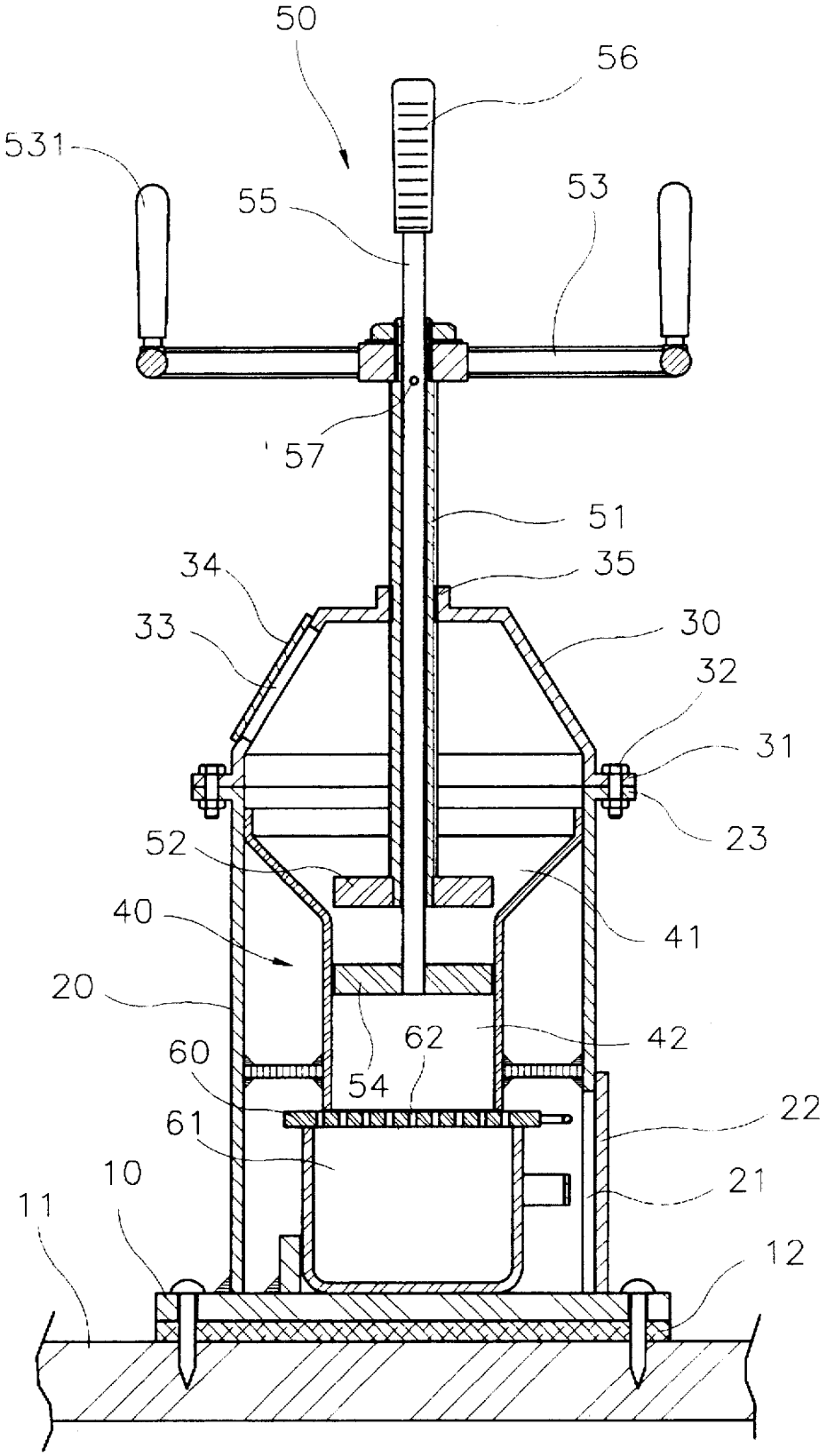
FIG. 1 is a sectional view of the structure of this invention's rubbish compressing apparatus.
Figure 2:
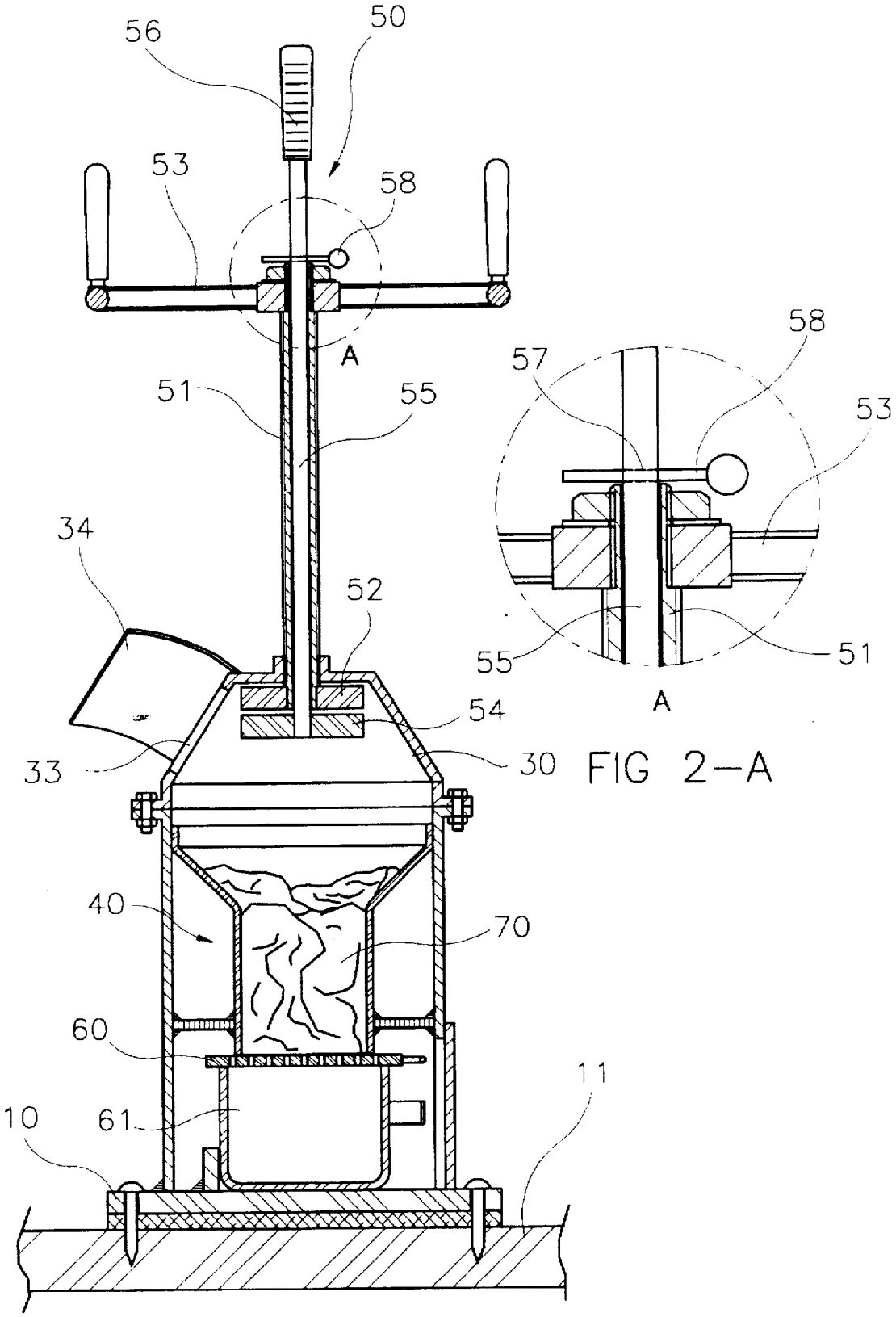

As shown in FIGS. 1 and 2, this invention mainly comprises the following: There is a base plate 10, which can be fastened to a work platform 11 or the ground, with a shock absorbing plate 12 or another shock absorbing device being inserted between the base plate 10 and the work platform 11 to absorb the shocks while this invention is operating. On the base plate 10 a main body 20 is mounted, which has a cap 30 on its upper end. Inside the main body 20 a funnel-shaped compress funnel 40 is provided to accommodate the rubbish to be treated. In the middle of the cap 30 there is a compressing device 50 to compress the rubbish in the compress funnel 40. In the opening at the lower end of the compress funnel 40 there are an anvil plate 60 and a container 61 suiting the compressing device 50 to compress and reduce the volume of the rubbish. One side of the main body 20 is provided with an aperture 21 and a side door 22 to enable the user to pull out the anvil plate 60 and the container 61 and to remove the compressed rubbish.

The perimeter on the top of the main body 20 is provided with a flange 23, and the cap 30 has on the location, where it is connected to the main body 20, a flange 31 coinciding with the flange 23. The flanges 23 and 31 are fastened together by several screw bolts 32, so the cap 30 is fastened to the top end of the main body 20.

The cap 30 is roughly shaped like a cone. It has a feeding aperture 33 and a side lid 34 on its side to feed rubbish into the compress funnel 40 inside the main body 20.

The upper section 41 of the compress funnel 40 is an outward opened cone to collect the rubbish inserted into the main body 20. The lower section 42 is a cylinder, inside which the rubbish is compressed. The container 61 is mounted below the opening at the lower end of the compress funnel 40. The anvil plate 60 is mounted on the upper end of the container 61 and its top side sticks closely to the opening at the lower end of the compress funnel 40. While compressing the rubbish, the anvil plate 60 holds back the rubbish allowing for its compression. After completion of the compression the anvil plate 60 will be pulled out, giving way for the rubbish to fall into the container 61. After that, using the container 61 the rubbish will be taken out of the main body. In addition, the anvil plate 60 has numerous drain holes 62 allowing any liquid inside the rubbish to flow into the container during compression.

As shown in FIG. 2, after opening the side lid 34 the rubbish 70 will be thrown through the upper part of the main body into the compress funnel 40. After that, the side lid 34 is closed again, and the rubbish 70 under goes compression by means of the compressing device 50 (as shown in FIGS. 3 and 4).

The compressing device 50 comprises: a threaded shaft 51, which passes through the middle of the cap 30, engaging with a threaded part 35 in the middle of the cap 30, and is itself provided with a long hole along its longitudinal axis; a first pressing plate 52, mounted on the bottom end of the threaded shaft 51; a horizontal wheel 53, mounted on the top of the threaded shaft 51 and provided with handles to let the user rotate the threaded shaft 51; a second pressing plate 54 below the first pressing plate 52; a shaft 55, which passes glidingly through the middle of the first pressing plate 52 and the long hole in the threaded shaft 51 and is connected to the second pressing plate 54; and a handle 56 on the top of the shaft 55 for the user to pull up the shaft 55 along with the second pressing plate 54.

As shown in FIG. 2, when operating this invention, the first and the second pressing plate 52 and 54 will first be fixed in the topmost position within the cap 30. Then the side lid 34 is opened, and the rubbish 70 is thrown through the feeding aperture 33 into the compress funnel 40. As shown in FIGS. 2 and 2-A, in order to let the second pressing plate 54 stay fixed in the topmost position within the cap 30, when the rubbish is thrown in, this invention's shaft 55 is provided with an eyebolt hole 57. The vertical position of the eyebolt hole 57, while the second pressing plate 54 is in its topmost position, is just above of the threaded shaft 51 and the horizontal wheel 53. An eyebolt 58 can be inserted in the eyebolt hole 57 (as shown in FIG. 2-A), thus fixing the position of the shaft 55 and the second pressing plate 54 and preventing them from interfering with the feeding of the rubbish 70 into the compress funnel 40.

Figure 3:
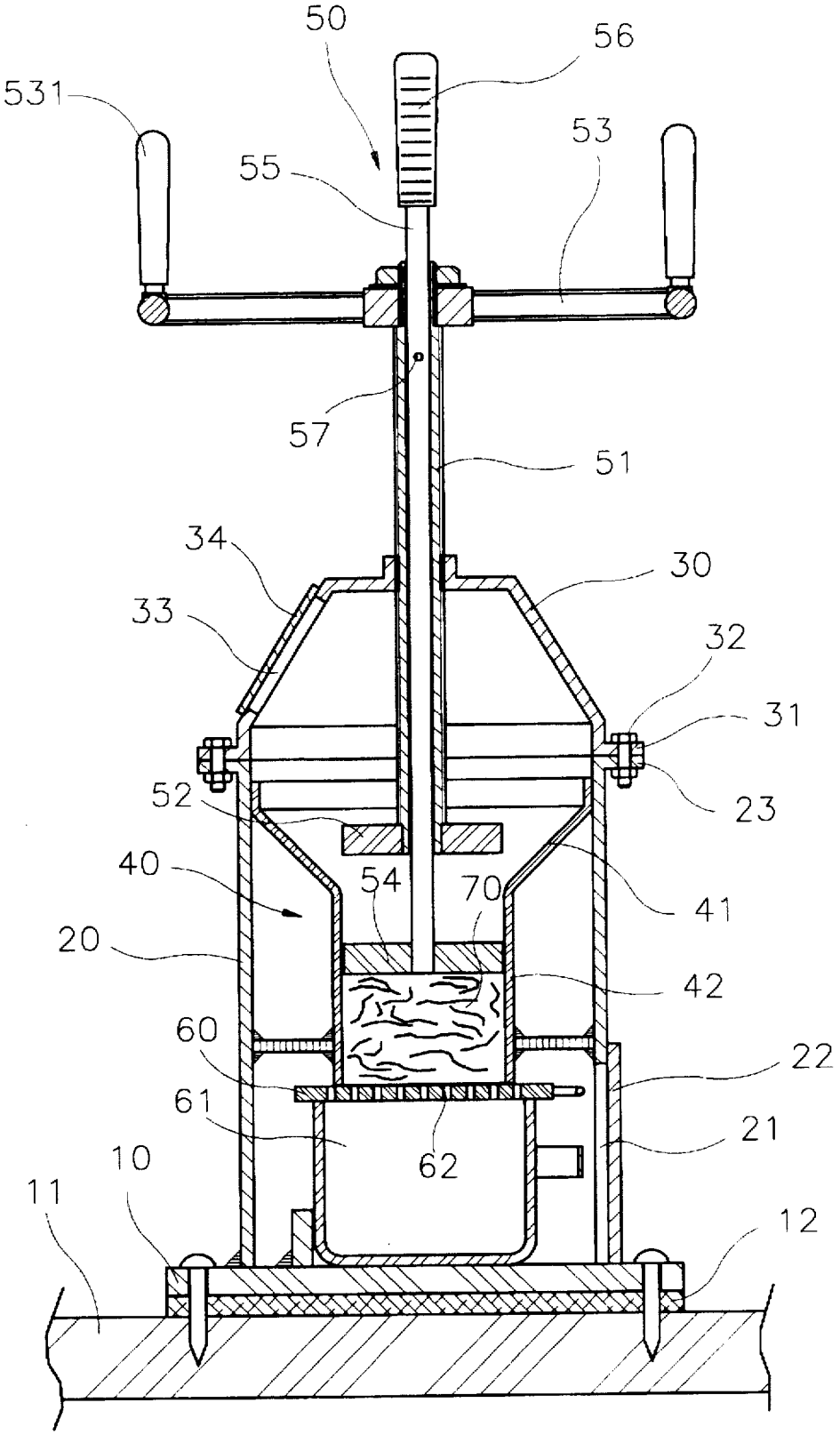
FIG. 3 is a sectional view to explain the operation of this invention compressing rubbish in its first stage.
Figure 4:
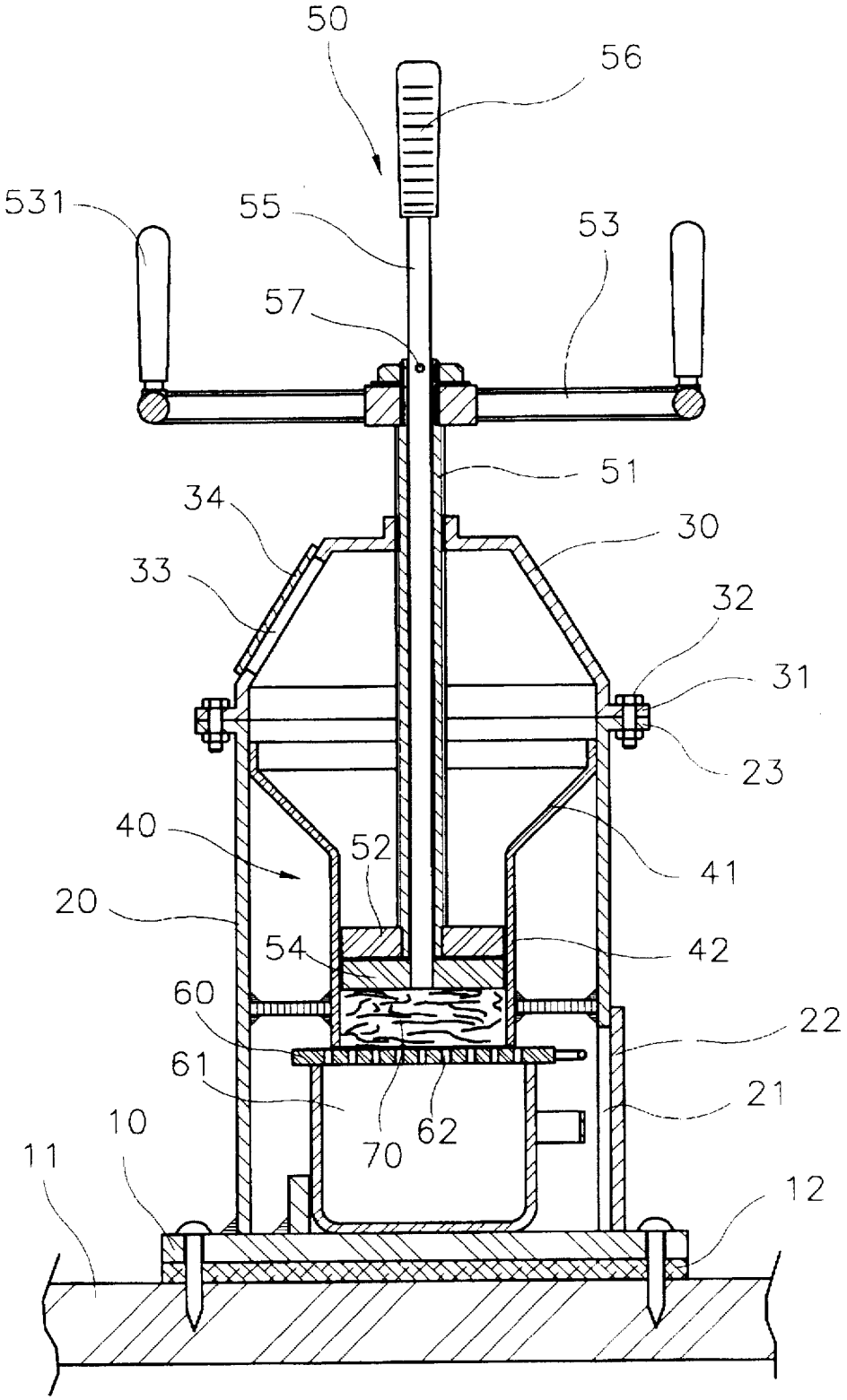
FIG. 4 is a sectional view to explain the operation of this invention compressing rubbish in its second stage.

As shown in FIG. 3, when the feeding of the rubbish is completed, the operator can pull out the eyebolt 58, directly push the shaft 55 and by means of the second pressing plate 54 pre-compress the rubbish 70 to a certain size. Then, as shown in FIG. 4, the horizontal wheel 53 and the shaft 51 are turned in a way that lowers the first pressing plate 52. The first pressing plate 52 pushes the second pressing plate 54 and compresses the rubbish 70 to its minimum volume.

Figure 5:
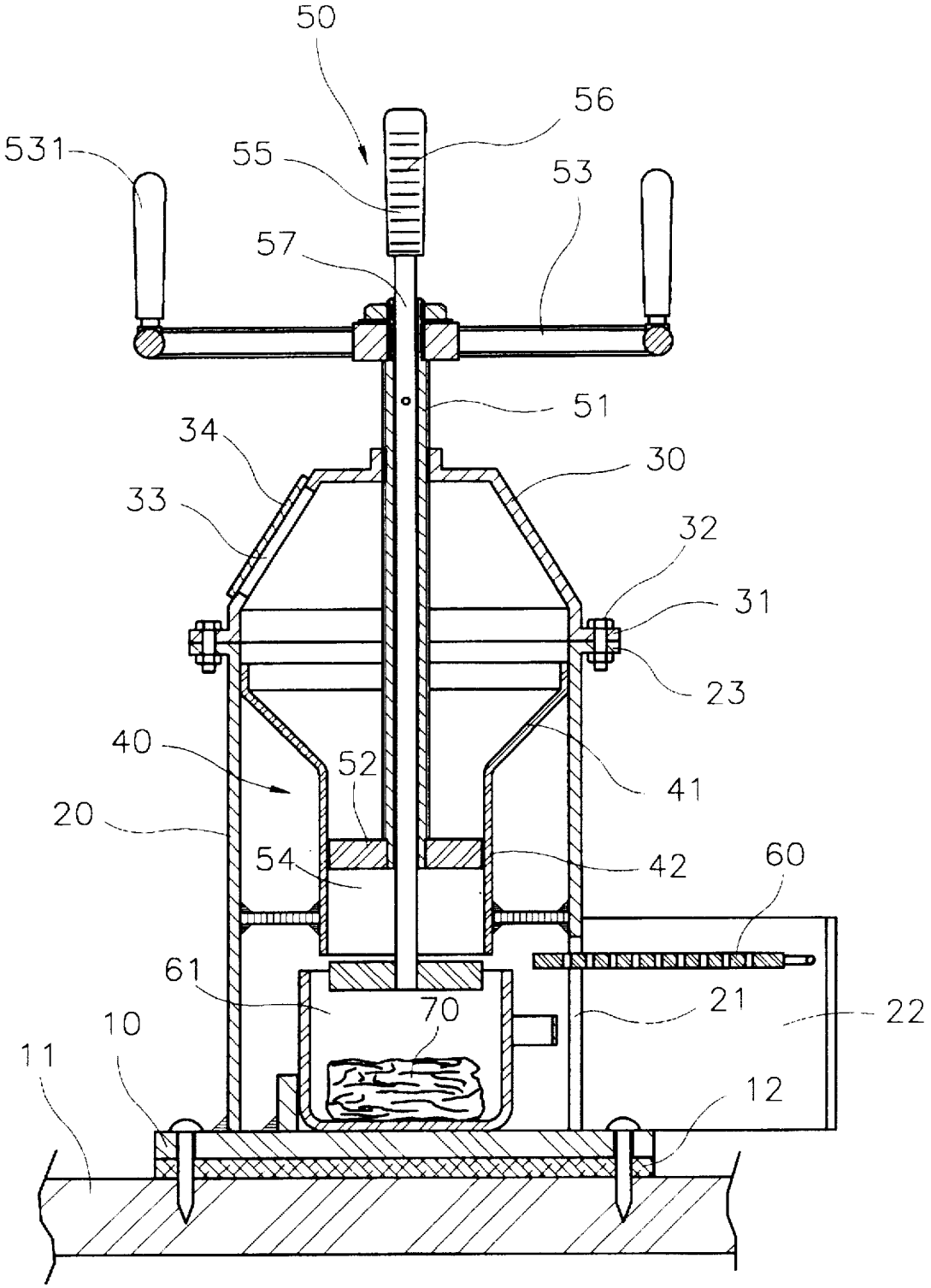
FIG. 5 is a sectional view to explain the operation of taking out the rubbish that has been compressed to one piece by this invention.

As shown in FIG. 5, when the compression of the rubbish is finished, the operator opens the side door 24 and pulls out the anvil plate 60. Then he pushes the rubbish 70, which has already been compressed to one piece, by means of the second pressing plate 54 through the opening at the lower end of the compress funnel 40, such that it falls into the container 61. After that, the operator draws out the container 61 through the aperture 21 on the side of the main body 20 to remove the rubbish from the main body 20.

A further point requiring explanation is that, when this invention's rubbish compressing apparatus deals with easily compressible rubbish, like aluminium cans, then employing only the second pressing plate 54 for compressing will suffice. Only if this invention's apparatus compresses, e.g., cans for powdered milk, plastic bottles or other not easily compressible garbage, usage of the first pressing plate 52 will be needed.

Figure 6:
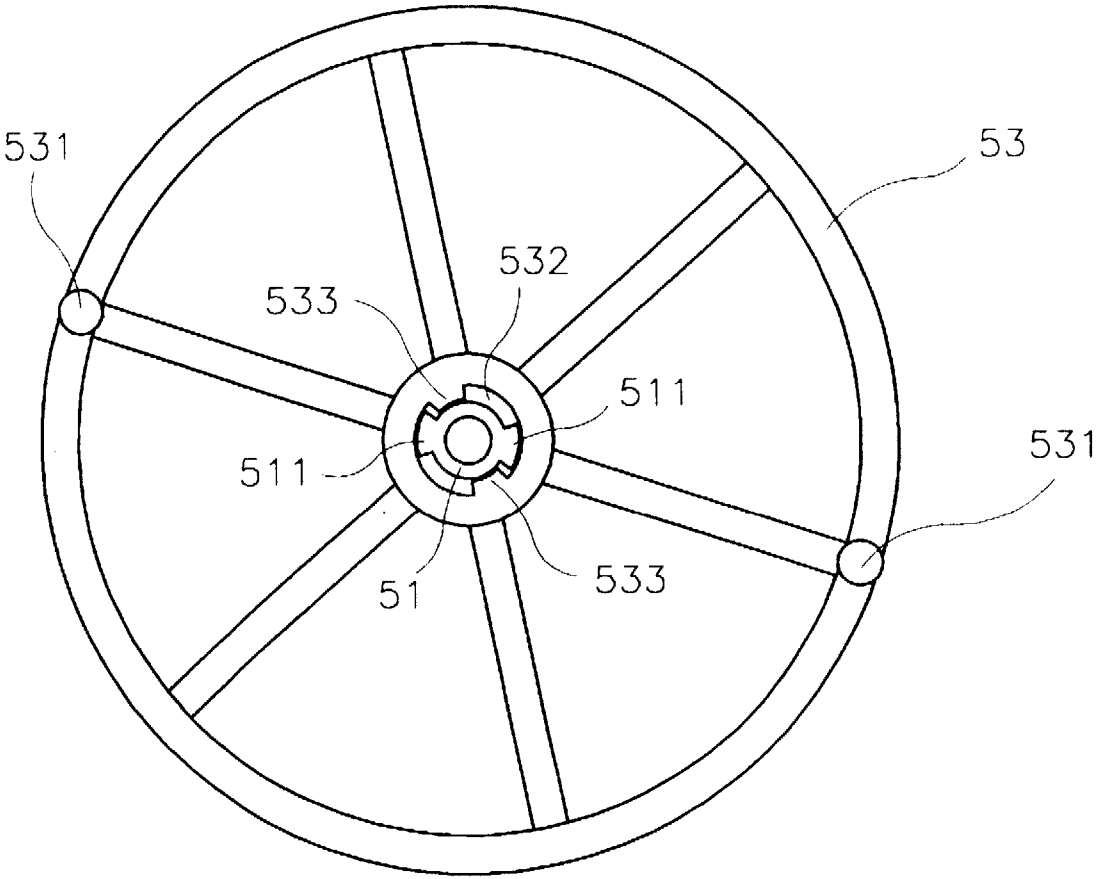
FIG. 6 is a top view to explain the special connecting structure of this invention's horizontal wheel and threaded shaft, to let the rotary plate in the second rubbish compressing stage push the threaded shaft lever by impact to increase the compressing effect.

Moreover, this invention's compressing device 50 can be varied in its design so as to enhance the compressing effect and save effort in operating it. For example, as shown in the embodiment of FIG. 6, the horizontal wheel 53 can drive the device connected with the threaded shaft 51 by impact. In this embodiment the horizontal wheel 53 rotatably surrounds the top part of the threaded shaft 51. The hole 532 of the horizontal wheel 53 which surrounds the threaded shaft 51 has a diameter larger than the diameter of the top part of the threaded shaft 51. It is provided with several inward protruding blockers 533. The top part of the threaded shaft 51, which is surrounded by the hole 532, has several outward protruding blockers 511. Each outward protruding blocker 511 is, separated from its own neighbor, located between a pair of two neighboring inward protruding blockers 533. Its width is much smaller than the width of the gap between two neighboring inward protruding blockers 533. Therefore, between the horizontal wheel 53 and the threaded shaft 51 there is a certain angular range of free rotational movement against each other.

Taking advantage of this linking system, the operator can at the end of the second stage of compression turn back the horizontal wheel 53 by a certain angle and quickly turn it forward again, in closing direction, so as to let the inward protruding blockers 533 bump against the outward protruding blockers 511 and, using this pushing force, drive the threaded shaft 51. Thereby, having compressed the rubbish by rotating the horizontal wheel 53, he can by impact driving further compress the rubbish and attain a better compression effect while saving effort.

Furthermore, this invention's compressing device, apart from using human power, can be designed to be driven by electric motors, oil pressure or compressed air to facilitate operation.

This invention provides for a simple-structured, easy-to-use rubbish compressing apparatus, its operation is very easy, and it can be used on a large scale in places like households and offices. Therefore, waste in households and offices can be readily compressed before discarding, and the volume of household waste will be greatly reduced, facilitating transport. At the same time, further treatment of waste is easier, helping to spread the sorting and recycling of waste. Finally, this invention's rubbish compressing apparatus will provide an opportunity for physical exercises to modern people moving too little, and thus attain a healthy effect.

What is claimed is:

1. A rubbish compressing apparatus, comprising:

a base plate;

a main body, mounted on said base plate and roughly having the shape of a cylinder, its top end having an opening for throwing in rubbish, its lower part being provided with an opening for removing rubbish;

a compress funnel, mounted fast inside said main body, taking in rubbish which has been thrown into said main body, the upper section of said compress funnel being a cone turned upside-down, the lower section being a cylinder, the lower section having an opening:

a compressing device, further comprising:

a threaded shaft, passing through the top end of said main body into said main body's inside;

a first pressing plate, mounted on the lower end of said threaded shaft;

a horizontal wheel, mounted on the top end of said threaded shaft to drive the rotation of said shaft;

a shaft, glidingly passing through said threaded shaft and said pressing plate along their rotational axis; and a second pressing plate, mounted in a position below said first pressing plate on the lower end of said shaft; and an anvil plate, which is mounted below the opening of the lower section of said compress funnel and which can be pulled out through the opening in the lower part of said main body;

whereat said second pressing plate can be taken by said shaft to enter said compress funnel to perform rubbish compression in its first stage and, after that, said threaded shaft drives down said first pressing plate, pushing said second pressing plate from above, thus performing further compression of said rubbish.

2. A rubbish compression apparatus as claimed in claim 1, wherein a container is provided below said anvil plate to support said anvil plate, wherein said anvil plate is removable, after said compressing device has finished compressing said rubbish, and wherein said rubbish is by means of said compressing device pushed through the opening in the lower part of said main body and falls into said container.

3. A rubbish compression apparatus as claimed in claim 2, wherein said anvil plate is provided with a plurality of drain holes to allow any liquid in said rubbish to flow into said container.

4. A rubbish compression apparatus as claimed in claim 1, wherein said horizontal wheel and said threaded shaft are linked by a link device, which allows said horizontal wheel to drive said threaded shaft by impact.

5. A rubbish compression apparatus as claimed in claim 4, wherein said link device further comprises:

a hole in the middle of said horizontal wheel, surrounding the top end of said threaded shaft;

a plurality of inward protruding blockers on the inner surface of said hole; and a plurality of outward protruding blockers on the top end of said threaded shaft, the number of said outward protruding blockers being equal to the number of said inward protruding blockers, each outward protruding blocker extending separately into the gap between a pair of two neighboring inward protruding blockers, while the width of each outward protruding blocker is smaller than the width of the gap between two neighboring inward protruding blockers.

6. A rubbish compression apparatus as claimed in claim 1, wherein said shaft is provided with an eyebolt hole, whose position is, when said second pressing plate is moved to a position close to said first pressing plate, just above the top of said threaded shaft and into which at that position an eyebolt can be inserted to fix the position of said second pressing plate, preventing it from dropping.

* * * * *